US007832151B2

(12) United States Patent
Harrisson et al.

(10) Patent No.: US 7,832,151 B2
(45) Date of Patent: Nov. 16, 2010

(54) PREFABRICATED BUILDING STRUCTURE WITH COLLAPSIBLE ROOF SECTIONS

(75) Inventors: Eric Harrisson, Carleton-sur-Mer (CA); Jean Pinault, Québec (CA); Pierre Bélanger, Cap-Sante (CA)

(73) Assignee: Les Habitations Mont-Carleton Inc., Carleton, Quebec (CA)

( * ) Notice: Subject to any disclaimer, the term of this patent is extended or adjusted under 35 U.S.C. 154(b) by 200 days.

(21) Appl. No.: 12/153,326

(22) Filed: May 16, 2008

(65) Prior Publication Data

US 2009/0193725 A1 Aug. 6, 2009

(30) Foreign Application Priority Data

Feb. 1, 2008 (CA) ..... 2619786

(51) Int. Cl.
*E04B 1/343* (2006.01)

(52) U.S. Cl. ..... 52/66; 52/71; 52/79.5; 52/79.1; 52/125.2; 52/122.1

(58) Field of Classification Search ..... 52/79.1, 52/79.5, 66, 71, 122.1, 125.2, 126.1, 127.1
See application file for complete search history.

(56) References Cited

U.S. PATENT DOCUMENTS

| | | | | | |
|---|---|---|---|---|---|
| 349,887 | A | * | 9/1886 | Keeler | 52/66 |
| 414,976 | A | * | 11/1889 | Harvey | 52/69 |
| 451,775 | A | * | 5/1891 | Satterlee | 52/66 |
| 471,217 | A | * | 3/1892 | Greenwald | 52/66 |
| 1,023,349 | A | * | 4/1912 | Aiken | 264/299 |
| 1,658,044 | A | * | 2/1928 | Fagan | 52/71 |
| 2,325,747 | A | * | 8/1943 | Dailey | 52/71 |
| 3,485,346 | A | * | 12/1969 | Ballard | 206/321 |
| 3,679,177 | A | * | 7/1972 | Scholz | 254/89 R |
| 3,714,746 | A | * | 2/1973 | Barlow | 52/69 |
| 3,736,708 | A | * | 6/1973 | Chapman | 52/92.2 |
| 3,763,607 | A | * | 10/1973 | Glover | 52/68 |
| 3,863,419 | A | * | 2/1975 | Hendrich | 52/745.14 |
| 3,872,631 | A | * | 3/1975 | Nowell | 52/67 |
| 3,905,486 | A | * | 9/1975 | Genson | 414/10 |
| 3,971,185 | A | * | 7/1976 | Hendrich | 52/745.14 |
| 3,983,665 | A | * | 10/1976 | Burton | 52/71 |
| 4,000,588 | A | | 1/1977 | van der Lely | |
| 4,074,475 | A | | 2/1978 | Wahlquist | |

(Continued)

FOREIGN PATENT DOCUMENTS

DE 199 19 053 A1 11/2000

*Primary Examiner*—Robert J Canfield
*Assistant Examiner*—Matthew J Gitlin
(74) *Attorney, Agent, or Firm*—Ogilvy Renault LLP

(57) ABSTRACT

A prefabricated building structure having a collapsible roof and adapted to be transported by a road carrier vehicle is described. The prefabricated building structure is provided with at least opposed parallel load bearing side walls. A roof section having a plurality of spaced roof rafters is pivotally connected by one or more pivot connections to a respective one of a top plate of each of the load bearing side walls. The roof sections are interconnectable to one another when the roof sections are disposed angularly upwards to form a raised pitch roof structure. A leverage beam is connectable to one of the rafters of each roof section and is securable to a cable which is secured to a pulley whereby to permit the roof sections to be raised or lowered.

19 Claims, 8 Drawing Sheets

U.S. PATENT DOCUMENTS 4,155,204 A * 5/1979 Prozinski ..... 52/69
4,171,600 A 10/1979 Whitney, Jr.
4,312,157 A * 1/1982 Hertel et al. ..... 52/13
4,467,585 A * 8/1984 Busby ..... 52/745.13
4,546,578 A * 10/1985 Behrmann ..... 52/67
4,567,709 A 2/1986 Faw
4,780,996 A * 11/1988 Julien, Jr. ..... 52/68
4,829,726 A 5/1989 de Potter d'Indoye
4,912,891 A * 4/1990 Bertrand ..... 52/66
4,942,701 A * 7/1990 Jones et al. ..... 52/126.1
5,094,059 A * 3/1992 Ganescu ..... 52/641
5,209,030 A * 5/1993 Sloditskie et al. ..... 52/79.5
RE34,468 E * 12/1993 Rau et al. ..... 296/260.02
5,461,832 A 10/1995 Smith
5,596,844 A * 1/1997 Kalinowski ..... 52/79.5
5,623,786 A * 4/1997 DeMeyer ..... 52/6
5,655,335 A * 8/1997 Vermeer ..... 52/66
5,778,604 A * 7/1998 Snow ..... 52/66
5,819,492 A 10/1998 Konicek
5,867,950 A * 2/1999 Claisse ..... 52/125.6
5,921,047 A * 7/1999 Walker ..... 52/585.1
6,000,191 A * 12/1999 Kessler ..... 52/745.15
6,079,163 A * 6/2000 Daoud ..... 52/74
6,079,174 A * 6/2000 Williams et al. ..... 52/243.1
6,226,932 B1 * 5/2001 Friedrich ..... 52/79.1
6,434,895 B1 * 8/2002 Hosterman et al. ..... 52/143
6,598,363 B1 * 7/2003 Ferguson et al. ..... 52/272
6,681,544 B2 * 1/2004 Wall ..... 52/745.2
6,705,051 B1 * 3/2004 Wall ..... 52/66
7,513,081 B2 * 4/2009 Armstrong ..... 52/79.1
2002/0083654 A1 * 7/2002 Bini ..... 52/66
2003/0089070 A1 * 5/2003 Wall ..... 52/741.1
2003/0106272 A1 * 6/2003 Pierce ..... 52/66
2005/0044804 A1 * 3/2005 Bin et al. ..... 52/79.5
2009/0013614 A1 * 1/2009 Rogers ..... 52/66

* cited by examiner

PREFABRICATED BUILDING STRUCTURE WITH COLLAPSIBLE ROOF SECTIONS

TECHNICAL FIELD

The present invention relates to a prefabricated building structure having a collapsible roof formed of two roof sections which can be raised or lowered on pivot connections connected to opposed load bearing side walls for transport by a road transport carrier vehicle.

BACKGROUND ART

Modular homes which are constructed in a plant and then shipped in sections on road transport vehicles are well known in the art. However, such prefabricated building structures need to have specific dimensions as stipulated by laws and regulations for their transportation on public roads. These building structures are usually fabricated in modules which are of substantially rectangular shape and these modules are connected together on a foundation once they are shipped to a building site. However, when the roofs of such building structures are intended to be pitched roofs, there is a constrained on height limitation and accordingly the roof needs to be either erected on the site or shipped separately in sections on another road vehicle. This has proven to be a costly process when the intention of a prefabricated modular structure is primarily to provide a structure which is economical and easy to erect on site, usually within hours.

From U.S. Pat. No. 6,681,544, it is known to fabricate and transport a small building structure having a pitch roof. As described in that patent, the pitch roof is made of two sections and these sections are folded flat on the rectangular supporting walls of the building structure which is placed on a flatbed transport vehicle for shipping to an erection site. Special clamps are provided to secure the roof structure in its collapsed position and then to permit the roof sections to be disposed at an elevated angular position to form the pitch roof. To do this, the patent in question provides a novel roof coupling and guiding mechanism that employs roller assemblies which can be temporarily or permanently installed. The roof coupling and guiding mechanism do not provide for the raising of the roof panels at the construction site. The coupling devices are only provided to guide and stabilize and control the direction of movement of the roof panels and a crane is required on site for effecting the lifting of the roof panels. These coupling devices permit the roof panels to roll or slide towards a final design ridge position above the walls so as to allow roof slopes of any desired pitch or to permit the creation of other roof designs such as gable roofs, mansard roofs, hip roofs, and shed roofs.

The present invention relates to a prefabricated building structure of the type as described in the above-mentioned patent but having a novel structural design whereby the prefabricated building structure can be shipped with the roof structure in a collapsed condition for transport by a road vehicle and wherein a leverage means is provided in association with one or more roof sections to permit the roof sections to be raised to form a pitch roof structure without the use of a crane.

SUMMARY OF INVENTION

It is a feature of the present invention to provide a prefabricated building structure of the small residential type and dimensioned for transport as a unitary structure by a transport road carrier vehicle with the roof sections retained in their collapsed position.

Another feature of the present invention is to provide a prefabricated building structure of the cottage-type and having opposed parallel load bearing side walls to which a roof section is pivotally connected and adapted to be raised by a leverage means secured to a roof rafter to form a raised pitch roof structure, the roof sections are interconnected together by a ridge plate secured to a top end of each of the rafters of the roof sections.

Another feature of the present invention is to provide a prefabricated building structure which has hinged roof sections which can be raised and lowered in an economical manner without the use of a crane.

According to the above features, from a broad aspect, the present invention provides a prefabricated building structure which is comprised of a floor structure and vertical side walls secured to the floor structure along an outside perimeter thereof. At least two of the side walls are opposed parallel load bearing side walls. Each of the opposed parallel load bearing side walls has a horizontal top plate extending therealong. A roof section having a plurality of spaced rafters, held together in spaced-apart relationship, is pivotally connected by one or more pivot connections to a respective one of the top plates. The roof sections are interconnectable to one another by connecting means when the roof sections are disposed angularly upwards to form a raised pitch roof structure. A leverage beam is slidingly retained in close sliding fit within at least a lower portion of one of the rafters which is at least partly a hollow structural rafter located in a predetermined region of each of the roof sections. The leverage beam has a lower leverage section extending out of the lower portion of the hollow structural rafter with a force transmitting section maintained in the hollow structural rafter. A force exerting means is connected to a free end portion of the lower leverage section of the leverage beam to cause the roof sections to be raised or lowered on their one or more pivot connections to form a raised pitch roof structure or a collapsed roof structure for transport of the prefabricated building structure by a road transport carrier vehicle.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
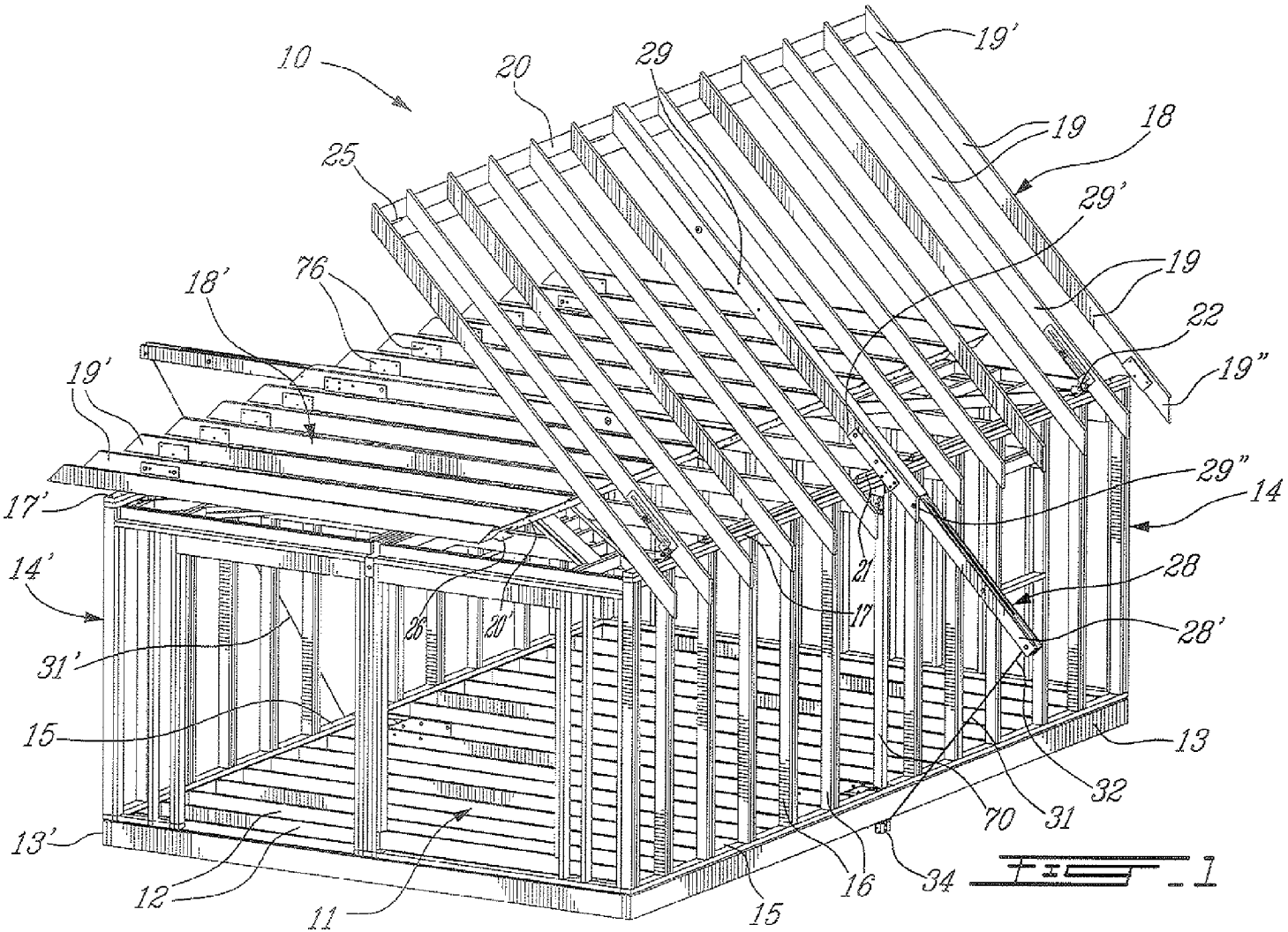
FIG. 1 is a perspective view showing the frame of the prefabricated building structure of the present invention with one of the roof sections being disposed at an elevated position and the other one being disposed at a collapsed position.

Referring now to the drawings and more particularly to FIGS. 1, 2, 3 and 8, there is shown generally at 10 the framing of a prefabricated building structure constructed in accordance with the present invention. The building structure as hereinshown is a small residential structure, such as a cottage, and dimensioned to meet the regulations for the transportation thereof over public roads by a transport carrier vehicle and wherein the building structure is prefabricated and transported as a unitary structure requiring only a single transport carrier vehicle.

As hereinshown the prefabricated building structure 10 is comprised of a floor framing 11 provided by a plurality of floor joists 12 which are attached to opposed headers 13 along the longitudinal side of the building structure. The building structure 10 is also provided with two opposed parallel load bearing side walls 14 and 14' which are provided at a lower end with a bottom plate 15 which is secured over the headers 13 and 13' and the end of the floor joist 12, in a conventional manner. The load bearing side walls 14 and 14" are also provided with reinforced studs 16, herein constituted by three lumber pieces secured together, such as 2×6 or 2×4 size pieces interconnected together by nails or screws whereby to support the heavy load of the roof structure and any snow load accumulated thereon.

Each of the opposed parallel load bearing side walls 14 and 14' have a horizontal top plate 17, as is conventional in such buildings structures, and extending therealong. There are two roof sections, herein roof section 18 and roof section 18', each formed by a plurality of roof rafters 19 and 19', respectively. Each roof section 18, 18' has its rafters 19 held together in spaced-apart relationship by roofing material not shown but obvious to a person skilled in the art. Metal ridge plates 20 and 20' are secured to the top ends 19' of the roof rafters 19.

As herein shown roof section 18 is pivotally connected to the top plate 17 by a substantially central pivot connection 21 and opposed adjustable pivot connections 22 which are secured to a specific one of the roof rafters 19 and spaced from a bottom end 19" of the rafters. It is to be understood that the pivot connections can be constituted by a different pivoting structure(s) to provide the roof sections hinge connection.

Figure 2:
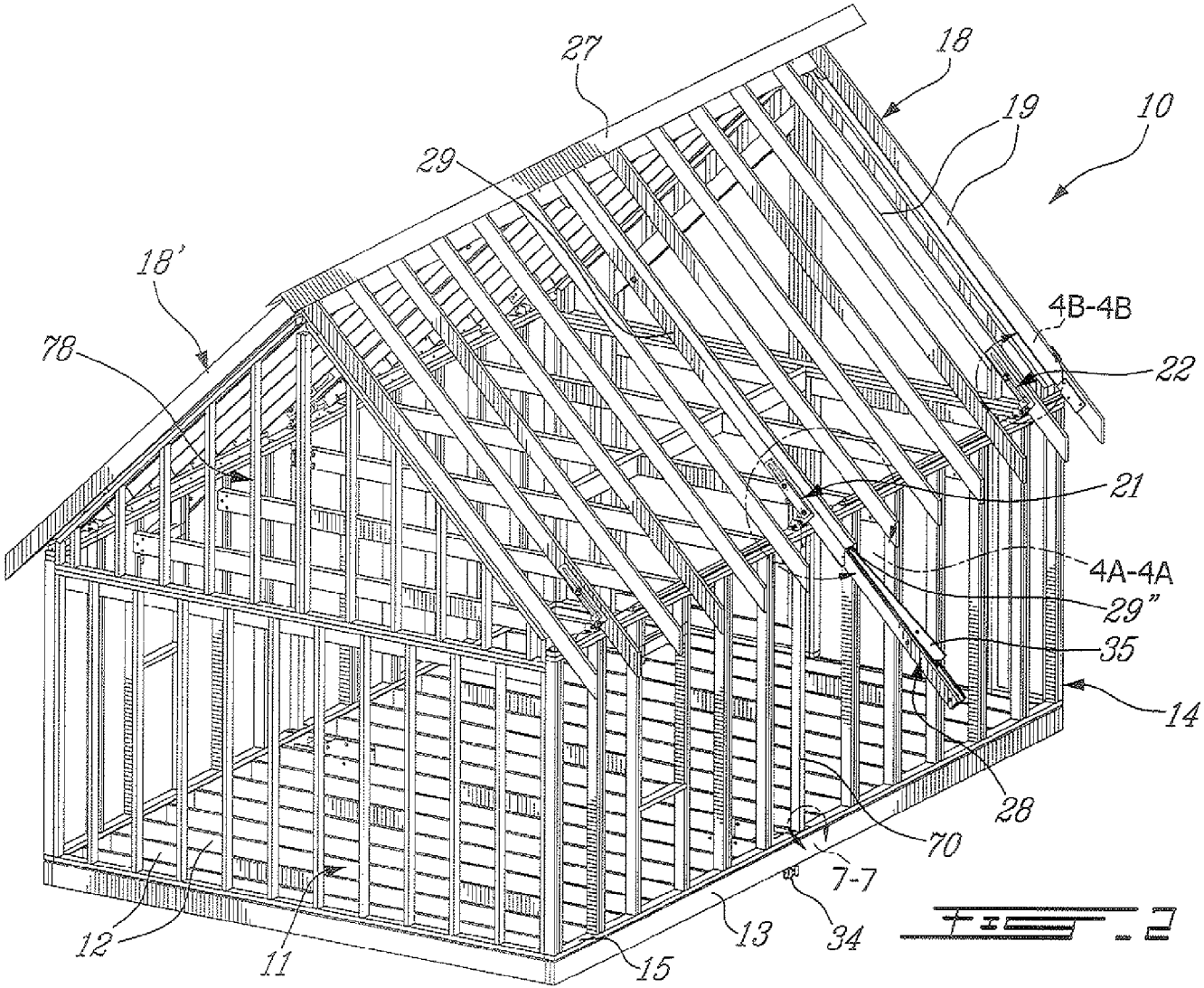
FIG. 2 is a further perspective view of the frame of the prefabricated building structure of the present invention and wherein the roof sections are shown in their raised interconnected position to form a pitch roof structure and wherein a leverage beam is shown partly assembled and extending from an open lower end of a structural roof rafter.
Figure 8:
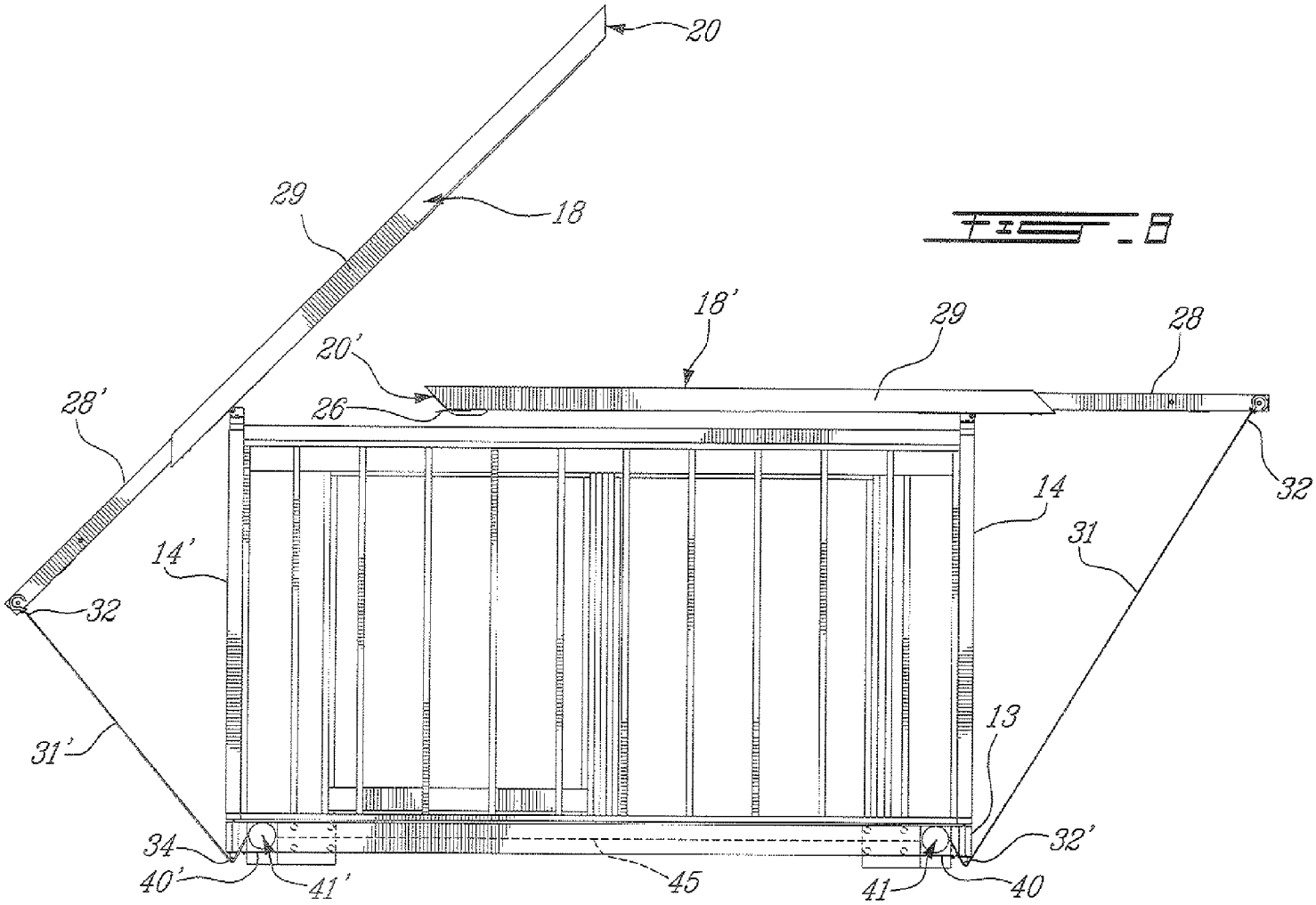
FIG. 8 is an end view of the prefabricated building structure of the present invention illustrating the construction of the leverage assembly to raise or lower the roof sections and illustrating the position of a load distribution cable in association therewith.

As shown in FIGS. 1 and 8, the ridge plate 20 is a rigid metal plate which is provided with connecting means in the form of connecting formations, herein constituted by slots 25 formed in ridge plate 20 and tongs 26 formed in the ridge plate 20' of the other roof section 18'. When the roof sections are raised and these ridge plates 20 and 20' are positioned to abut one another in facial relationship, they are connected together with the tongs 26 projecting along the ridge plate 20' extending in the slots 25 formed in the ridge plate 20 and coinciding therewith. Accordingly, these roof sections are interconnected together by the ridge plates 20 and 20' and cannot move. After assembly, the tong 26 projecting through the slot 25 may be bent inwardly to prevent its disconnection from the slot but this is not essential as the load of these roof sections will maintain these connections secured in mating interconnection. Of course, sheeting material is secured over the roof rafters as well as shingles to complete the roof and this adds considerably to the roof weight. Thereafter a roof cap 27, shown in FIG. 2, is secured over the roof peak by internal connecting attachments secured thereunder and connectable to some of the roof rafters 19 whereby the cap is held in position without screws extending through the cap but from under the roof cap to prevent any ingress of water. Proper openings, not shown, are provided for the passage of the cap attachments.

Figure 5A:
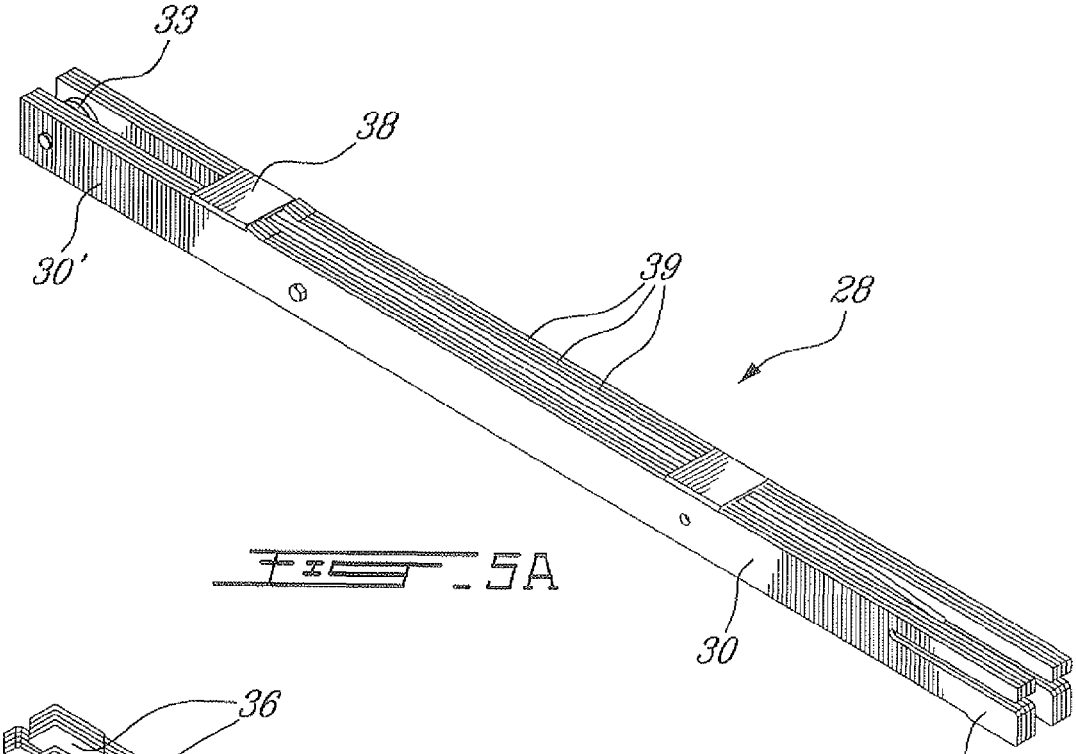
FIG. 5A is a perspective view showing the construction of an assembled leverage beam adapted to be removably connectable in the hollow structural rafter.
Figure 5B:
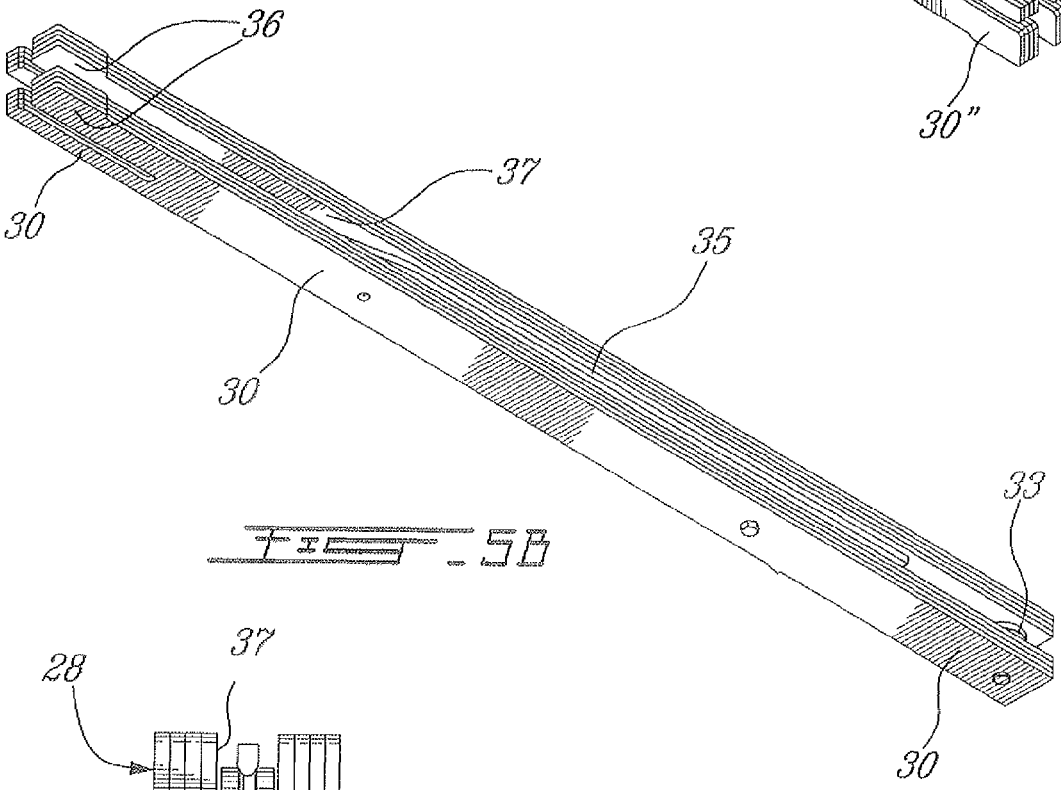
FIG. 5B is a perspective view similar to FIG. 5A but shown from the underside thereof.
Figure 5C:
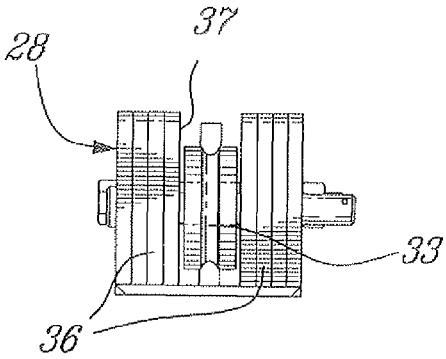
FIG. 5C is an end view of FIG. 5A illustrating the construction of the leverage beam and the cable attachment pulley associated therewith.
Figure 7:
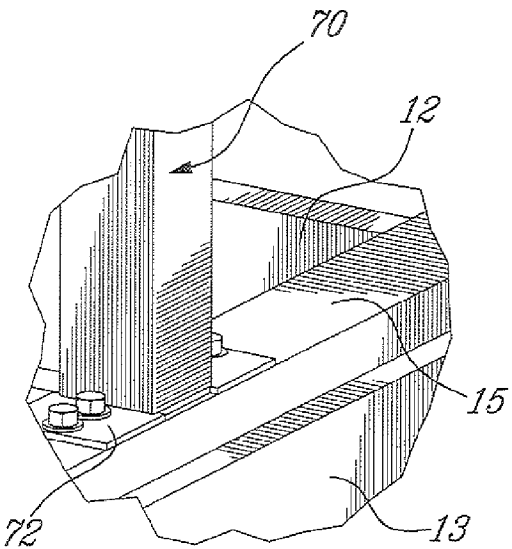
FIG. 7 is a fragmented perspective view showing the lower attachment plate of the reinforced metal stud secured to a bottom plate of a load bearing side wall.

A novel feature of the prefabricated building structure 10 of the present invention is the provision of a unique actuable leverage means to provide for the raising and lowering of the roof section on their pivotal connections. This leverage means as herein shown, is constituted by a leverage beam 28 which is slidingly retained in close sliding fit within at least a lower portion 29' of at least one of the roof rafters 19, herein roof rafter 29 which is a hollow structural metal rafter and which is located in a predetermined region of the roof section, herein in a central region thereof. The leverage beam 28 has a lower leverage section 28' which extends out of the lower portion 29' of the hollow structural rafter 29 with a force transmitting section 30 (see FIGS. 5A and 5C) maintained and retainable in the lower portion 29' of the hollow structural rafter 29. Force exerting means in the form of a steel cable 31 and winch 41 (see FIG. 8) are connectable at one end 32 to an attachment, herein a pulley 33, held at a lower end 30' of the leverage beam, as shown in FIGS. 5A to 5C. The other end of the steel cable, namely the lower end 32', is guided about a cable guide pulley 34 below a lower edge of the floor header 13 and connects to a winch 41.

Figure 9:
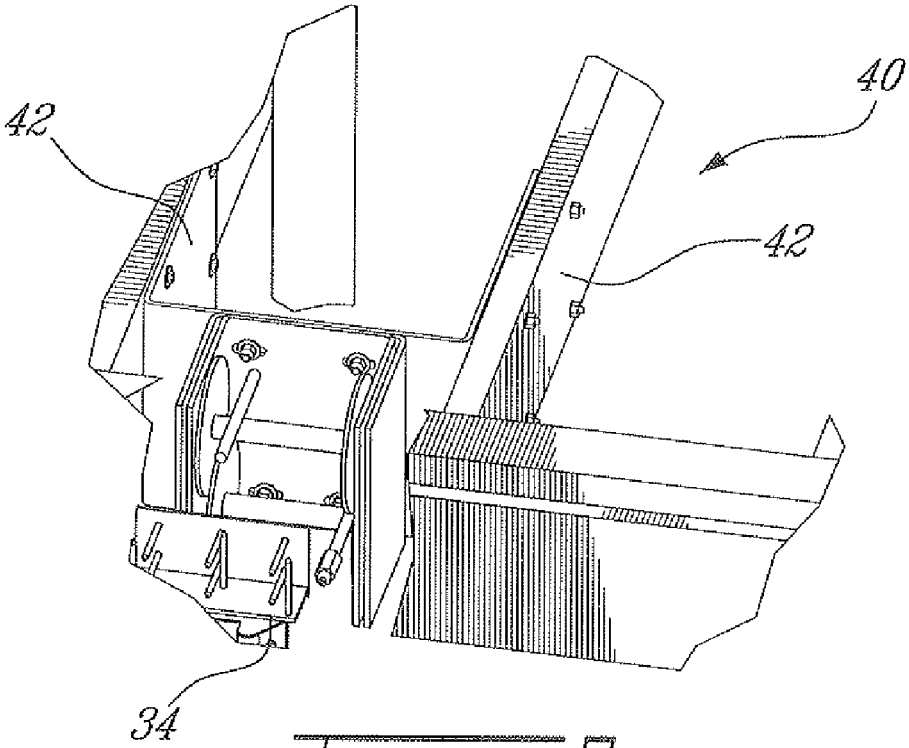
FIG. 9 is a fragmented section view showing the construction of the winch support bracket.
Figure 10:
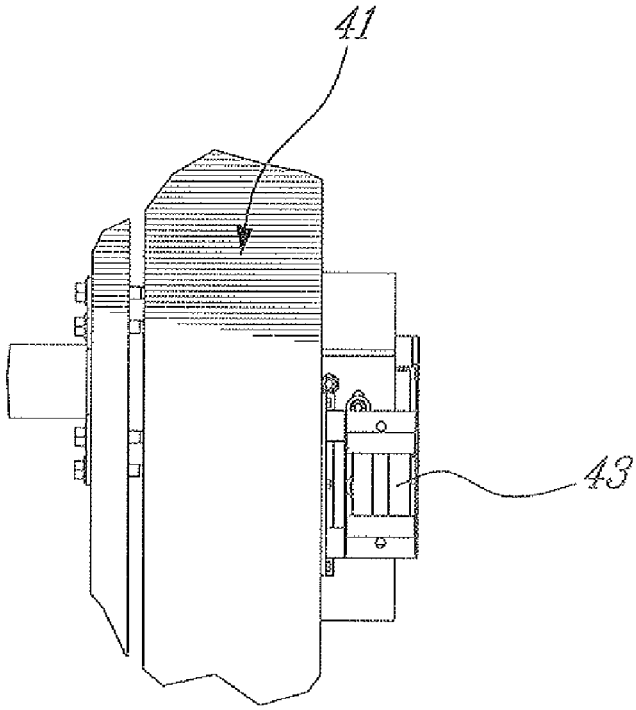
FIG. 10 is a side view of a winch for raising or lowering an associated one of the two roof sections.

As shown in FIG. 9, a support bracket 40 is secured between floor joist 12 of the floor structure 11 in substantially vertical alignment with the leverage beam 28 and behind the floor header 13 of the floor structure. The cable guide pulley 34 is rotatably mounted on this winch support bracket 40 to guide the steel cable 31 free of a lower edge of the floor header 13. The winch 41, as shown in FIG. 10, is secured between the opposed flanges 42 and 42' of the floor bracket 40 and connected to a sheave 43 of the winch. The winch may be removed from the bracket after the roof sections are raised and used for another building structure. The bracket 40 remains concealed. The winch as hereinshown is an electrical winch, actuated by a 12-volt battery, or an electric drill operated winch or any suitable winching means provided it can lift the load.

As shown in FIG. 8, a lateral load distribution steel cable 45 may be interconnected between the winch support brackets 40 and 40' secured on opposed sides of the floor structure 11 and in transverse alignment with one another. Accordingly, the pulling force exerted on the cable 31 by the winch 41 is distributed along this steel load distribution cable 45 which is attached to the other pulley 41' secured to the opposed bracket 40' and secured to the other leverage beam 28' by cable 31'. This cable 45 distributes the loads imparted on the pulleys when raising the roof sections.

It is pointed out that the leverage beams 28 and 28' may be permanently retained within the hollow structural rafters 29, as illustrated in FIG. 8. This provides further reinforcement to the structural rafter and such leverage beams merely need to be slid out a limited amount due to arresting formations formed at the inner end of these telescopic leverage beams. In order to raise the roof sections, the leverage beams 28 and 28' are pulled out of their respective hollow roof rafter 29 and the cable 31 is secured to the attachment 33 at the free outer end thereof. The cable 31 is wound on the sheave 43 of the winch 41 and pulled out to connect to the leverage beam.

The winch is then actuated either by a pneumatic tool or by a hand crank whereby to pull the cable 31 inwardly. This draws the leverage beam inwards and raises the roof section 29 on its pivot connections 21 and 22 until it reaches a substantially desired angle. The opposite roof section 18' is then raised whereby the ridge plates 20 and 20' are in substantially facial alignment. Then by manipulating the winch the roof sections are lowered closer to one another until the tongs 26 are aligned with their respective slots 25 formed in the ridge plates. The roof sections are lowered again to couple the ridge plates together with the tongs projecting in the slots.

As shown in FIGS. 5A to 5C, the leverage beam 28 is a reinforced beam herein constructed of metal plates 39 interconnected together by connecting plates 38. The plates are assemble to form two spaced-apart beam sections 30' and 30" which are connected in spaced, parallel relationship and define a longitudinal gap 37 therebetween once held in position by the connecting plates 38. The inner end of the beam 28 has a connecting formation 36 for removable retention thereof in the lower portion 29' of the hollow structural rafter 29. A central beam section 35, and as also illustrated in FIG. 2, is disconnectable from within the longitudinal gap 37 and placed in the gap during the beam assembly as it is positioned into the rafter 29. The central beam section 35 is removed from the gap 37 for the removal of the leverage beam 28 from the hollow structural rafter 29. As shown in FIGS. 2 and 4A, this leverage beam is assembled from the lower open end 29" of the structural hollow beam 29. Two of these removable leverage beams are utilized for raising the roof structure and after the roof structure is raised and connected, the leverage beams are disconnected and utilized for raising the roof sections of another like building structure.

With more specific reference now to FIGS. 2, 4A and 4B there will be described the construction and connections of the pivot connections 21 and 22. As shown in FIG. 4A, the central pivot connection 21, is securable to the central structural roof rafter 29, and is comprised of an elongated slide arm 50 which is secured to a pivot support bracket 51. The bottom end of the slide arm 50 has a transverse connecting leg 52 which is pivotally secured at a lower end to a pivot pin 53 which is held between a pair of flanges 54 of the pivot support bracket 51. The bracket 51 is secured on the top surface of the top plate 17. The bracket 51 has horizontal flanges 55 to connect to the top plate 17. A stud 70 is positioned under the bracket 51, as will be described later, where the loading takes place.

The elongated slide arm 50 is provided with a horizontal slot 56 for the passage of one or more bolts 57 disposed across the rafters in appropriate holes and threadably secured at a free end to a clamping plate 58 disposed against the slide arm and outwardly thereof. The clamping plate 58 has appropriate guide protrusions or bearings on an inner face thereof (not shown) and protruding in the slot 56 for sliding guided displacement therewith. The clamping plate 58, when clamped against the elongated slide arm 50 will lock the slide arm at a desired location along the rafter 29 to immovably secure the pivot assembly to the rafter 29 when the roof sections have been coupled to form a pitch roof, as shown in FIG. 2. When the rafters are in their collapsed position the clamping plate loosens whereby the roof sections can be slid closer inside the outer peripheral frame structure of the building by the adjustable pivot connections 22. As shown in FIG. 4A, the rafters are at their fully outwardly retracted position. During transport of the building structure 10, the roof sections are moved inwardly by loosening the bolts 57 and sliding the rafters and the entire roof structure forwardly within the building in the direction of arrow 60.

Figure 4B:
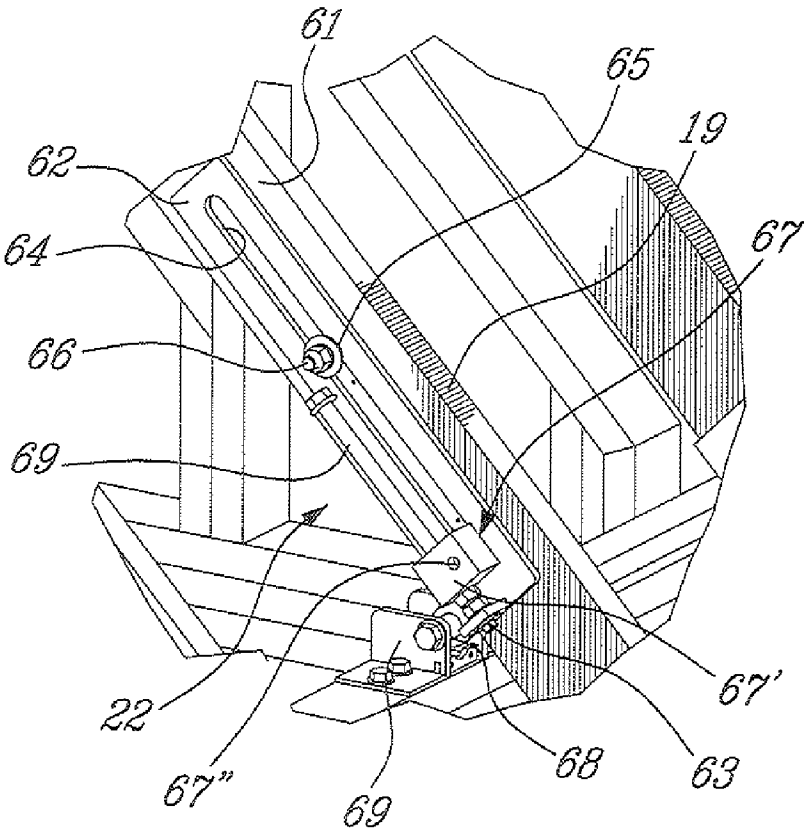
FIG. 4B is a further perspective view showing the construction of the adjustable pivot connection associated with a rafter adjacent an end of the load bearing side walls and of the roof sections.
Figure 4A:
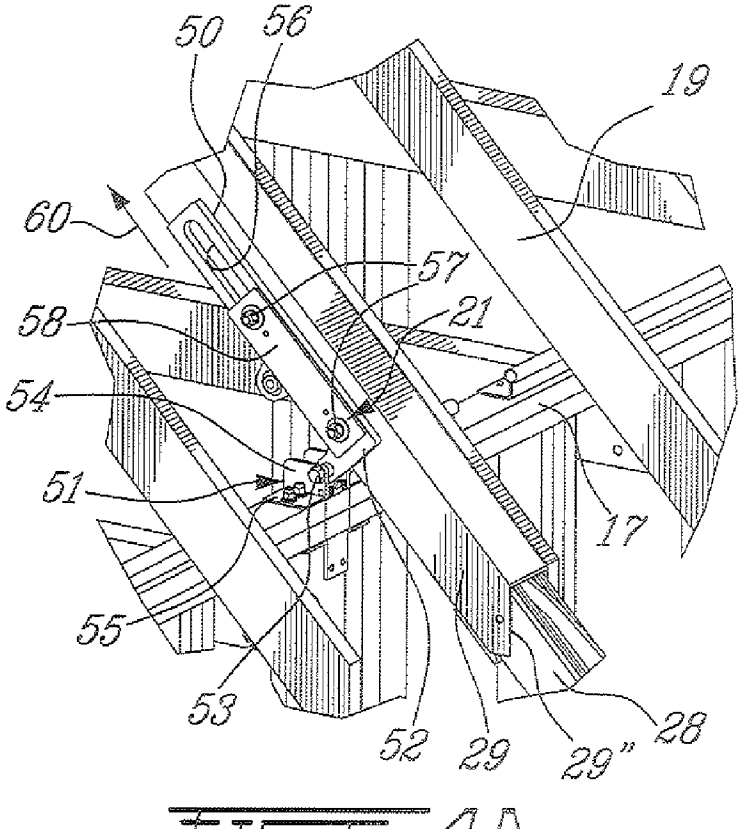
FIG. 4A is a fragmented perspective view showing the construction of the pivot connection associated with the hollow rafter adapted to receive the telescopic leverage beam.

With reference now to FIG. 4B there will be described the construction and operation of the adjustable pivot connections 22 which are secured at opposed ends of the load bearing side walls 14 and 14' or any other convenient location. The adjustable pivot connections 22 are also secured to the top plate 17 of the load bearing side walls 14 and 14' and adjacent a side face 61 of a roof rafter 19, herein the second roof rafter from the end rafters of the roof sections. The adjustable pivot connection is also comprised of a side arm 62 connected to a pivot support 63 and with the side arm extending along the side face 61 of the roof rafter 19. The side arm 62 also has a horizontal slot 64 for the passage of one or more bolts 65 disposed across the rafter 19 to immovably secure the side arm 62 and consequently the pivot connection 22 to the rafter 19. A lock element, herein a washer and nut assembly 66 arrest the side arm 62 against the rafter 19 at a desired position.

An adjustable linkage 67 is connected to the rafter 19 to provide for displacement of the rafter with the nut assembly moving along the slot 64 from opposed ends of the roof sections to move the roof sections 14 and 14' inwardly. To do so the linkage 67 has a housing 67' in which is supported an endless threaded bolt 68 coupled to a threaded rod 69 secured to the side arm 62. The bolt 68 has an Allen key head (not shown) accessible through a hole 67" provided in the housing 67'. By rotating the bolt 68 the housing and rafter 19 move along the slot 64 with the nut 66 loosened. When the nut 66 is tightened the side arm 62 is immovably secured to the rafter at a desired position. During this displacement the bolts 57 of the central pivotal connector 21 are loose.

Figure 6B:
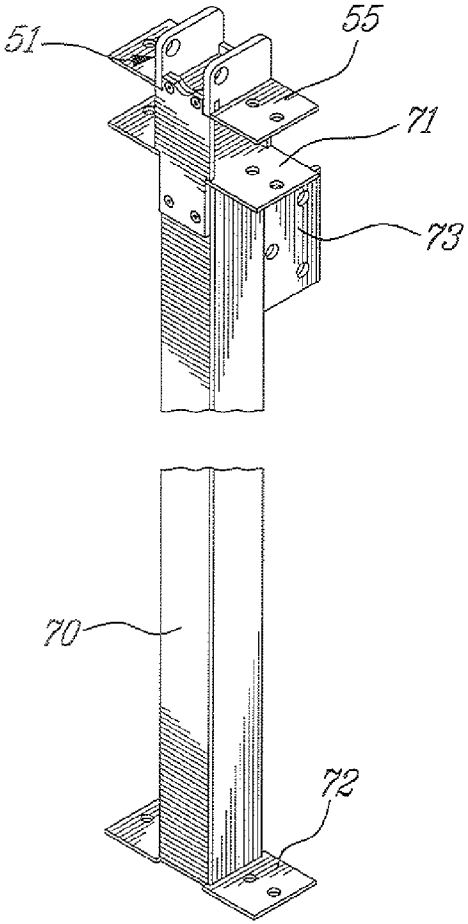
FIG. 6B is a fragmented perspective view similar to FIG. 6A but showing the backside of FIG. 6A.
Figure 6A:
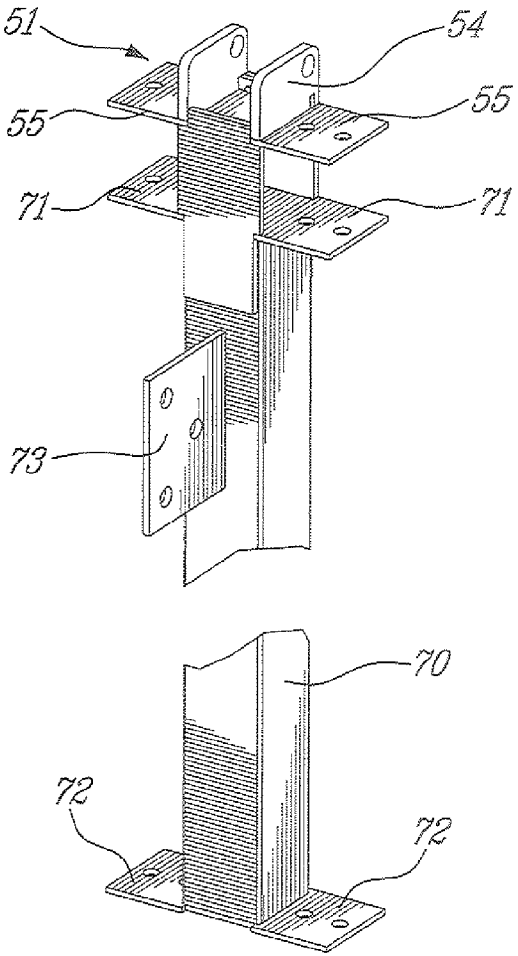
FIG. 6A is a fragmented perspective view illustrating the construction of the reinforced metal stud and its attaching brackets.

With reference now to FIGS. 6A and 6B, there is shown the construction of the reinforced metal post 70 which constitutes a stud of the load bearing side walls 14 and 14' and disposed under the top plate 17 in line with the central pivotal connector 21. In fact, the support bracket 55 is welded at the top end of this metal post whereby to reinforce the load bearing walls in the area where the pulling force on the leverage beam 28 is applied whereby to transmit some of this loading downwardly into the vertical walls. The reinforced stud 70 is of substantially square cross-section and is provided at a top end with the pivotal support bracket 51, as previously described. Further lateral flanges 71 are provided to secure the top portion of this post to the underside of the top plate 17. Foot flanges 72 are also provided to secure the bottom end of the post 70 over the bottom plate 15 of the side walls 14 and 14'. An inwardly projecting transverse flange 73 is also provided for the interconnection of a central ceiling joist 74 to provide cross-bracing. As herein shown, the ceiling joist 74 extends transversely between the reinforced metal studs 70 and 70' of the opposed load bearing side walls 14 and 14'. Accordingly, there is also a strong lateral interconnection across the central region of the structure where the pivotal connections 21 are located and where the load is applied by the leverage beams during the lifting and lowering of the roof sections. Thus, it can be appreciated that the entire central plane of this building structure is reinforced.

Figure 3:
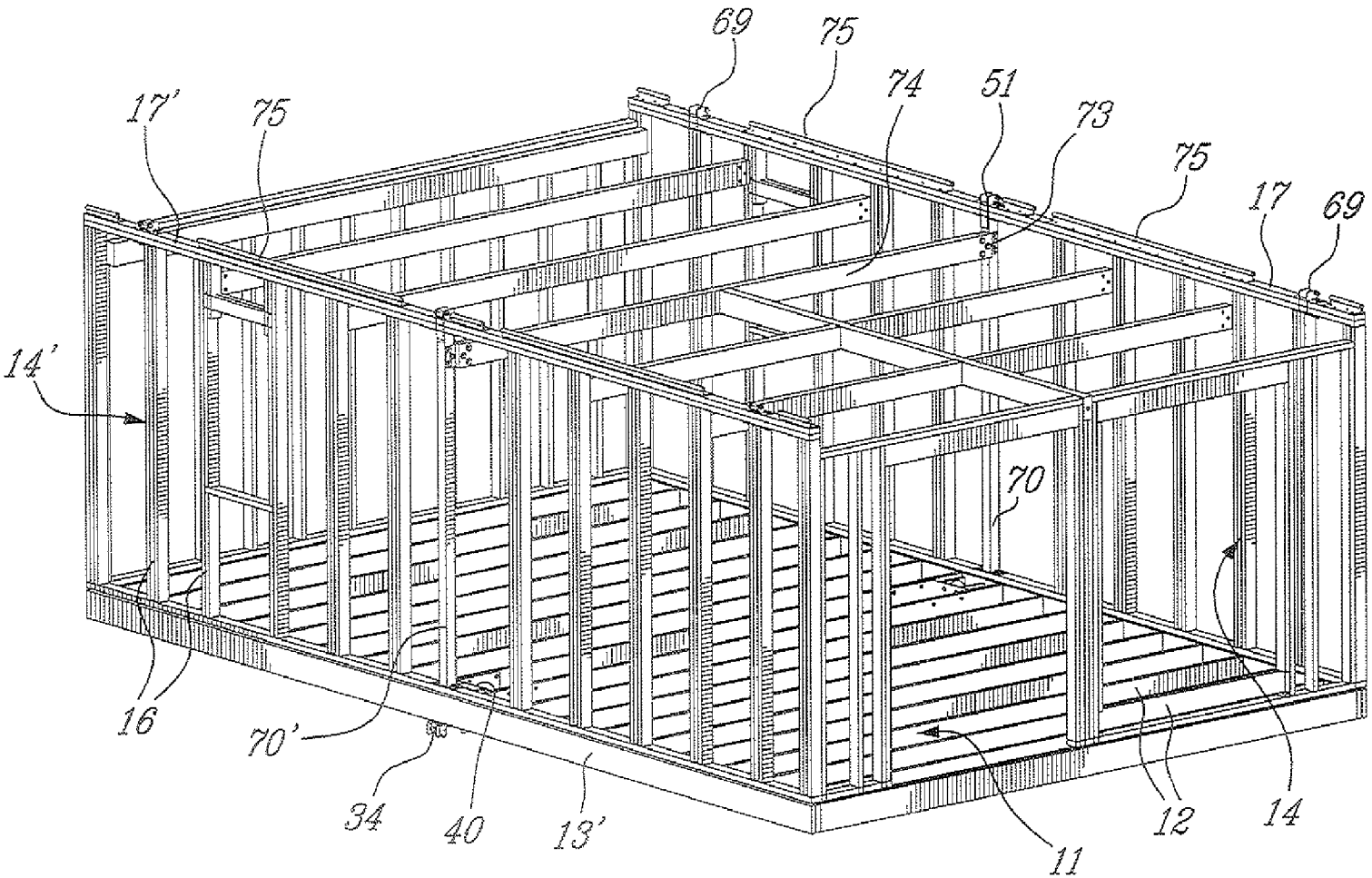
FIG. 3 is a further perspective view of the frame of the side walls and ceiling joist assembly.

With reference now to FIGS. 3 and 4A, it can be seen that the top surface of the top plates 17 and 17' are provided with rafter support spacers 75 whereby to provide a support and a means of securement of the roof rafters which are not provided with pivot connections. These spacers 75 provide for all of the rafters to be supported in the same plane over the load bearing side walls 14 and 14'. The rafters 19 can be connected to the support spacers 75 by brad nails or any other fasteners.

As also shown in FIG. 1, reinforcing galvanized plates 76 may also be secured to the rafters which are not connected to the pivot connections 21 and 22. These reinforce plates 76 are galvanized plates, well known in the art, and provide reinforcement in this area. They may also extend under the rafters.

It is to be understood that for ease of description of the prefabricated building structure of the present invention that the structure is illustrated in its skeleton or framed form with no sheeting material secured thereto. However, in reality, all of the framing as hereinshown is covered with appropriate external finishing materials to provide for a finished building structure with wall cladding, windows and doors installed and the roof sections being covered with proper sheeting and shingles. The end gables 78 are also shipped in a collapsed form, under or over the collapsed roof sections, and are placed in position and secured after the roof sections are secured together. Further, all of the outside sheeting and cladding can be effected on the erection site and transported in bulk inside the outer peripheral wall structure, as illustrated in FIG. 3. Therefore, the prefabricated building structure 10 can be fabricated as a kit with some materials supplied depending on the need of a customer and this usually depends on costs and the construction skills of the customer.

It is within the ambit of the present invention to cover any obvious modifications of a preferred embodiment described herein providing such modifications fall within the scope of the appended claims.

We claim:

1. A prefabricated building structure comprising a floor structure and vertical side walls secured to said floor structure along an outside perimeter thereof, at least two of said side walls being opposed parallel load bearing side walls, each said opposed parallel load bearing side walls having a horizontal top plate extending therealong, two roof sections having a plurality of spaced rafters held together in spaced-apart relationship and pivotally connected by pivot connections to said top plate of a respective one of said opposed parallel load bearing side walls, said roof sections being interconnectable to one another by connecting means when said roof sections are disposed angularly upwards to form a raised pitch roof structure, leverage beam slidingly retained in close sliding fit within at least a lower portion of one of said rafters which is at least partly a hollow structural rafter located in a predetermined region of each said roof sections, said leverage beam having a lower leverage section extending out of said lower portion of said hollow structural rafter with a force transmitting section maintained in said hollow structural rafter, and a force exerting means connectable to a free end portion of said lower leverage section of said leverage beam to cause said roof sections to be raised or lowered on their said pivot connections to form said raised pitch roof structure or a collapsed roof structure for transport of said prefabricated building structure.

2. A prefabricated building structure as claimed in claim 1 wherein a cable is connectable at one end to said free end portion of said lower leverage section of said leverage beam and at another end to said force exerting means to apply a pulling force on said cable to raise each said roof sections on said pivot connections or to apply a releasing force to lower said roof sections on said one or more pivot connections.

3. A prefabricated building structure as claimed in claim 2 wherein said force exerting means is a winch having a drum about which a portion of said cable is wound.

4. A prefabricated building structure as claimed in claim 1 wherein said hollow structural rafter is a metal rafter, said leverage beam being a reinforced metal beam.

5. A prefabricated building structure as claimed in claim 4 wherein said leverage beam is slidingly retained captive in said hollow structural rafter and entirely storable therein.

6. A prefabricated building structure as claimed in claim 4 wherein said leverage beam is removably connectable in said lower portion of said hollow structural rafter.

7. A prefabricated building structure as claimed in claim 4 wherein said predetermined region is located substantially centrally in each said roof section.

8. A prefabricated building structure as claimed in claim 1 wherein said connecting means is a ridge plate secured to a top end of said rafters of each said roof section and maintaining said rafters in said spaced-apart relationship, and connecting means to secure said ridge plate of each said roof section together when said roof sections are raised and positioned to form said pitch roof structure.

9. A prefabricated building structure as claimed in claim 8 wherein said ridge plate is a rigid metal plate, each metal plate having connecting formations for matingly engaging with one another to connect said two rigid metal plates together to secure said top ends of said rafters of said two roof sections to form a roof peak.

10. A prefabricated building structure as claimed in claim 9 wherein an elongated metal roof cap is secured over said roof peak by internal connecting attachments which are connectable to some of said rafters of each said roof sections under said roof cap.

11. A prefabricated building structure as claimed in claim 1 wherein said one or more pivot connections are each comprised of a slide arm secured to a pivot support and extending along a side face portion of an associated one of said roof rafters, said pivot support being secured to said top plate, said slide arm having a horizontal slot for the passage of one or more bolts disposed across said rafter and threadably secured to a clamping means disposed against said slide arm outwardly thereof, said clamping means arresting said slide arm at a desired location along said rafter by tightening said bolts to thereby adjust the longitudinal position of said rafter of said roof sections with respect to an associated one of said opposed load bearing sidewalls.

12. A prefabricated building structure as claimed in claim 11 wherein one of said pivot connections is secured substantially at mid-length of said top plate, and wherein a ceiling joist is secured transversely between a selected one of reinforced studs of said opposed parallel load bearing side walls closest to said pivot connection on said top plate structure of said opposed parallel load bearing side walls.

13. A prefabricated building structure as claimed in claim 12 wherein one of said pivot connections is an adjustable pivot connection secured to said top plate for attachment to a side face of a rafter adjacent opposed ends of each of said opposed load bearing sidewalls, each said adjustable pivot connection being comprised of a side arm secured to a pivot support and extending along a side face of said rafter, said side arm having a horizontal slot for the passage of one or more bolts disposed across said rafter, a lock element secured to said bolts to arrest said side arm against said rafter at a desired position and constituting said clamping means, said pivot support having an adjustable linkage to provide displacement of said roof sections inwardly of said opposed load bearing sidewalls for the transportation of said building structure by a road transport carrier with said roof sections in their collapsed position.

14. A prefabricated building structure as claimed in claim 1 wherein there is further provided rafter support means secured to a top face of said top plate members to support said rafters of said roof sections which are not provided with said pivot connections in aligned relationship with said rafters having said pivot connections.

15. A prefabricated building structure as claimed in claim 12 wherein said reinforced studs closest to said pivot connection at substantially mid-length of said top plate is a metal post stud, said metal post stud being provided at opposed ends thereof with attaching brackets for immovable securement at a top end to said top plate, and at a bottom end to a foot plate of said load bearing side walls, said attaching bracket at said top end having pivot support flanges extending above said top plate for receiving a pivot pin of said pivot connection at mid-length of said top plate.

16. A prefabricated building structure as claimed in claim 6 wherein said leverage beam is a removably connectable leverage beam comprised of two spaced apart beam sections interconnected in spaced parallel relationship and forming a longitudinal gap therebetween, said leverage beam having an outer end provided with an attaching means for connection of said cable thereto, said beam having an inner end provided with a connecting formation for removable retention thereof in said lower end section of said hollow structural rafter, and a central beam section dimensioned for close fit in said longitudinal gap and connectable therein after said inner end of said beam has been inserted in said lower end section of said hollow structural rafter, said central beam section being disconnected form said longitudinal gap and removed therefrom for removal of said leverage beam from said hollow structural rafter.

17. A prefabricated building structure as claimed in claim 3 wherein said winch is secured to a winch support bracket secured between floor joists of said floor structure in substantially vertical alignment with said leverage beam and behind a floor header of said floor structure, and a cable guide pulley rotatably mounted on said winch support bracket for guiding said cable free a lower edge of said floor header.

18. A prefabricated building structure as claimed in claim 3 wherein a lateral load distribution cable is interconnected between said winch support brackets secured on opposed sides of said floor structure in transverse alignment with one another.

19. A prefabricated building structure as claimed in claim 1 wherein said prefabricated building structure is a small residential building structure dimensioned for transport as a unitary structure with said roof sections in said collapsed position by a transport road carrier vehicle with said roof sections retained collapsed.

* * * * *